US006961963B2

(12) United States Patent
Rosie

(10) Patent No.: US 6,961,963 B2
(45) Date of Patent: Nov. 8, 2005

(54) MODULAR HELMET

(75) Inventor: Andrew MacPherson Rosie, Sheffield (GB)

(73) Assignee: Modular Helmet Systems Limited, (GB)

( * ) Notice: Subject to any disclaimer, the term of this patent is extended or adjusted under 35 U.S.C. 154(b) by 0 days.

(21) Appl. No.: 10/952,539

(22) Filed: Sep. 27, 2004

(65) Prior Publication Data

US 2005/0060793 A1 Mar. 24, 2005

Related U.S. Application Data

(63) Continuation of application No. PCT/GB03/01411, filed on Apr. 1, 2003, now abandoned.

(30) Foreign Application Priority Data

Apr. 4, 2002 (GB) ..... 0207819

(51) Int. Cl.[7] ..... A42C 5/04

(52) U.S. Cl. ..... 2/171.3; 2/7; 2/10; 2/422; 2/423; 2/424; 128/200.28; 128/201.24

(58) Field of Search ..... 2/410, 171.3, 424, 2/422, 423, 6.6, 6.7, 5, 7, 415, 10; 128/201.24, 128/200.28

(56) References Cited

U.S. PATENT DOCUMENTS

| | | | | |
|---|---|---|---|---|
| 2,888,681 A | | 6/1959 | Stuart et al. | |
| 3,239,842 A | * | 3/1966 | Marchello | 2/422 |
| 3,496,854 A | * | 2/1970 | Hill et al. | 454/370 |
| 3,551,910 A | * | 1/1971 | Raschke | 2/424 |
| 4,852,562 A | * | 8/1989 | Howie | 128/201.25 |
| 4,975,980 A | | 12/1990 | Ersteniuk | |
| 5,438,494 A | | 8/1995 | Harlan | |
| 5,517,691 A | | 5/1996 | Blake | |
| 5,533,500 A | * | 7/1996 | Her-Mou | 128/201.25 |
| 5,940,889 A | * | 8/1999 | Shirai | 2/411 |
| 6,032,297 A | | 3/2000 | Barthold et al. | |
| 6,035,451 A | * | 3/2000 | Burns et al. | 2/424 |
| 6,138,283 A | | 10/2000 | Kress | |
| 6,332,228 B1 | * | 12/2001 | Takahara | 2/422 |

FOREIGN PATENT DOCUMENTS

| | | | | |
|---|---|---|---|---|
| DE | 3214020 | | 7/1983 | |
| EP | 465971 | A2 * | 1/1992 | A42B 3/30 |
| EP | 0471264 | | 2/1992 | |
| FR | 2629986 | | 10/1989 | |
| FR | 2717990 | | 10/1995 | |
| GB | 2015868 | | 9/1979 | |
| GB | 2133275 | | 7/1984 | |
| GB | 2175490 | | 12/1986 | |
| GB | 2361408 | | 10/2001 | |
| JP | 2002-4127 | | 1/2002 | |
| WO | 99/45810 | | 9/1999 | |
| WO | 02/19855 | | 3/2002 | |

* cited by examiner

*Primary Examiner*—Rodney M. Lindsey
(74) *Attorney, Agent, or Firm*—Thompson Hine LLP

(57) ABSTRACT

A modular helmet system having a helmet base to protect from impacts the crown of a wearer's head and terminating basally in a rear rim and side rims; a C-shaped extension detachably connected to said rims to protect from impacts, when fitted to the helmet base, the base of a wearer's skull; and a crown comb detachably connected centrally over the crown of the helmet base. The helmet base is provided with ventilation windows centrally located over its crown. The comb covers and seals said ventilation windows. The comb is also employed to secure the extension in place, when fitted on the helmet base.

41 Claims, 9 Drawing Sheets

MODULAR HELMET

CROSS-REFERENCE TO RELATED APPLICATION

This application is a continuation of PCT International Application No. PCT/GB03/01411, filed Apr. 1, 2003 (now abandoned).

BACKGROUND

The present invention relates to helmets, and in particular to helmets adaptable to different situations.

In the rescue services there are various levels of protection needed depending on the situation personnel are likely to find themselves.

Thus firefighters need maximum protection against impacts to the head coming from both above and to the sides and from behind the head. They also need effective all-round flame and heat protection.

On the other hand, paramedics need less protection, on the whole, when entering a fire or accident situation to treat a victim. It is not likely that they will expose themselves to the same risks as firefighters because it is not their role to bring fires under control. They are not interfering with building structures, at least not to the same extent as firefighters. Moreover, they need all their senses, including hearing to treat patients effectively.

Finally, in mountain rescue, the helmet is primarily to protect against falls (rather than against falling object impacts) and the operator is often exerting more physical effort. Thus different levels of protection, and ventilation, are again required.

U.S. Pat. No. 4,975,980 discloses a firefighter helmet having an integral adjustable fire-resistant ear flap and hood. U.S. Pat. No. 6,032,297 discloses a helmet constructed from a number of components. GB-A-2361408 discloses a motorcycle helmet constructed from component parts that clip together. DE-A-3214020 and GB-A-2175490 both show a modular crash helmet comprising a base helmet and various components that can be added to configure the helmet in different ways, for example by the addition of a ring element to convert the helmet from open-face to full-face protection.

Presently commercially available helmets permit attachment of various items such as head lamps, cameras, visors etc.

SUMMARY

It is an object of the present invention therefore to provide a helmet capable of meeting the demands of different applications.

In accordance with the present invention there is provided a modular helmet system comprising:

i) a helmet base to protect from impacts to the crown of a wearer's head and terminating basally in a rear rim and side rims;

ii) a C-shaped extension detachably connected to the rims to protect from impacts, when fitted to the helmet base, to the side and rear of a wearer's skull; and iii) a crown comb detachably connectable centrally over the crown of the helmet base and arranged, when the extension is employed, to secure the extension in place on the helmet base.

Preferably said helmet base is provided with ventilation windows. The windows may be centrally located over the crown of the helmet base.

The comb may cover and seal said ventilation windows. Preferably, the comb is detachably connectable to the helmet base independently of the extension.

Preferably, the extension has two arms and a body, at the end of each arm there being provided an upstanding catch element, and the side rims have a slot to receive the catch elements when the base and extension are moved towards one another in an engagement direction.

Preferably, the catch elements engage catch lugs in the slots by movement transverse to the engagement direction after moving the catch elements into the slots.

Preferably, the comb has a sleeve at its base to receive a pin, and the helmet base has a pair of open-sided cups facing one another at the back of the helmet base, the open sides opening towards the front of the helmet base, whereby the comb is connected to the helmet base by inserting said pin in said sleeve, engaging the ends of the pin in the cups, and rotating the comb so as to lever it over the crown of the helmet base.

Preferably, the comb has a latch on its front end remote from said sleeve and adapted to engage a corresponding element on the front of the helmet base. The latch may comprise a pair of transversely and outwardly facing barbs on the end of resilient prongs. The corresponding element in this event may comprise a slot opening in the front wall of the helmet base, into which opening the prongs can enter, the barbs snapping into engagement with the ends of the slot opening. The prongs are preferably engageable to release the comb from the helmet base from under and inside the front of the helmet base.

The extension preferably has a pair of coaxial rings on its body, having an inner separation between them of an amount slightly greater than the length of the sleeve. The cups are separated from one another by an amount slightly greater than the outer separation of the rings; whereby the extension is connectable to said helmet base by (i) engaging the comb with the extension by sliding the pin through the rings and sleeve when the rings are aligned with and surround the sleeve; (ii) engaging the catch elements in the slots by movement of the extension towards the helmet base in the engagement direction and until the extension abuts the rims and the catch elements are aligned with the catch lugs; and (iii) simultaneously engaging the ends of the pin in the mouths of the cups by movement of the extension in the direction transverse the engagement direction and by pivoting the comb around the pins to lever it over the crown of the helmet base, pull the pin into full engagement with the cups, and also pull the catch elements into engagement with the catch lugs, and whereby the pin is prevented from disengaging the cups, the sleeve and rings.

Engagement of the crown comb over the helmet base prevents the extension moving opposite the transverse direction to release the elements and lugs.

The catch elements may comprise hooks and the lug studs. The opening of the hooks may be rearwardly directed with respect to the helmet base.

The studs may be axles of accessory attachment brackets provided on the sides of the base helmet, which axles pass through apertures formed in the sides of said slots.

Thus, with the helmet base alone, protection against impacts from above are provided while ventilation can be had to the top and sides of the wearer's head and up and through the helmet via the ventilation slots.

When the crown comb alone is added, a further layer of impact protection, over the most likely area for impacts from falling objects, is provided. Thus, the helmet in this form has application for paramedics, where side impacts are not so likely, good protection from falling objects is desirable, but where ventilation is not such a pressing requirement.

Moreover, the central crown line of the helmet is that part most likely to become scuffed, in time. Consequently the facility to exchange crown combs permits the aesthetic appearance of the helmet to be maintained. Indeed, the crown comb provides a convenient location for identification indicia or decals.

Finally, when the extension and crown comb are employed maximum protection from impact is provided, while at the same time routes for the passage of flame or hot gases through the helmet are minimized.

Indeed, the primary use of the system according to the invention is not so much that different users will always use the system in just one of its forms, but rather that any user can adapt the system to suit different situations. It may be that firefighters might typically use the system in its most protective form, but equally they may from time to time meet situations where less protection is needed and ventilation is wanted. Likewise, paramedics and the like might typically use the system in its lightest form, but may occasionally enter situations where a greater level of protection is needed.

Indeed, the invention separately provides a crown comb and an extension for the helmet system of the invention.

BRIEF DESCRIPTION OF THE DRAWINGS

The invention is further described hereinafter, by way of example, with reference to the accompanying drawings, in which.

DETAILED DESCRIPTION

Figure 1A:
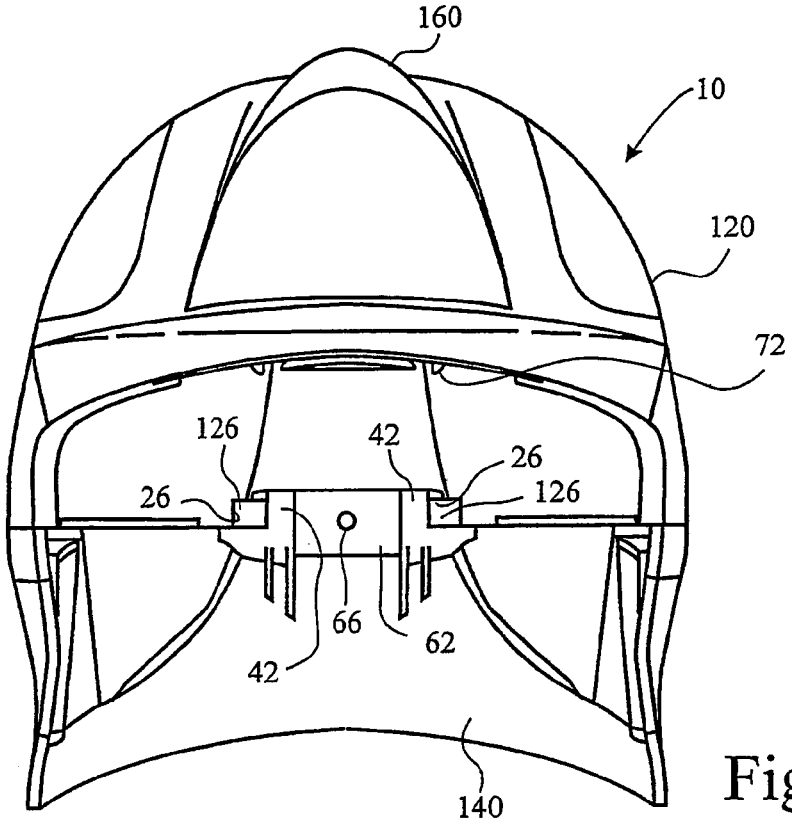
FIGS. 1*a*–1*d* show, respectively, a front view, rear view, plan view and side view of a helmet fully assembled in accordance with the present invention.
Figure 1B:
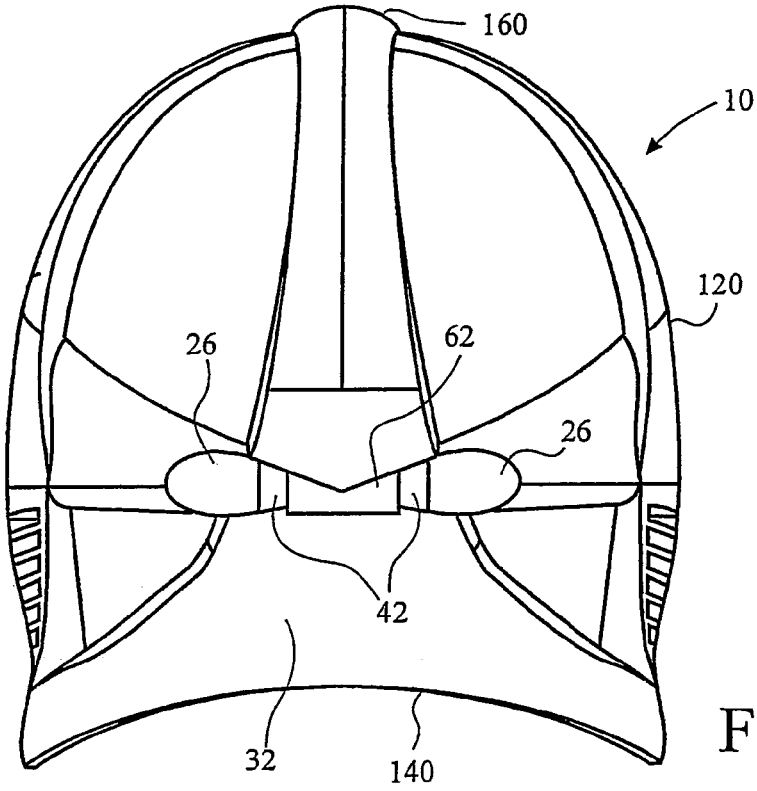
Figure 1C:
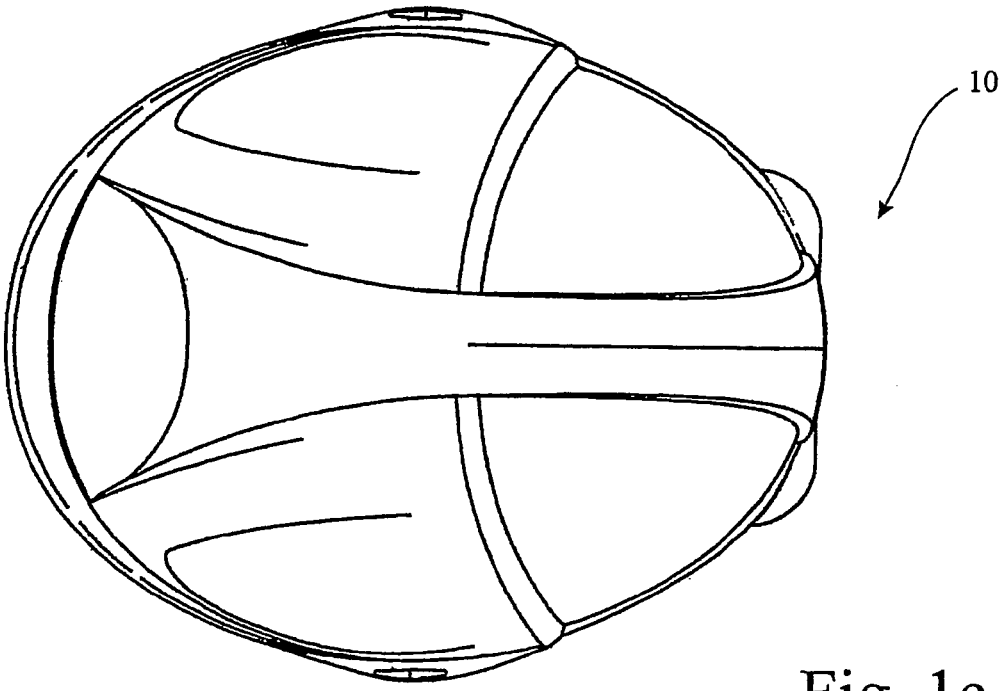
Figure 1D:
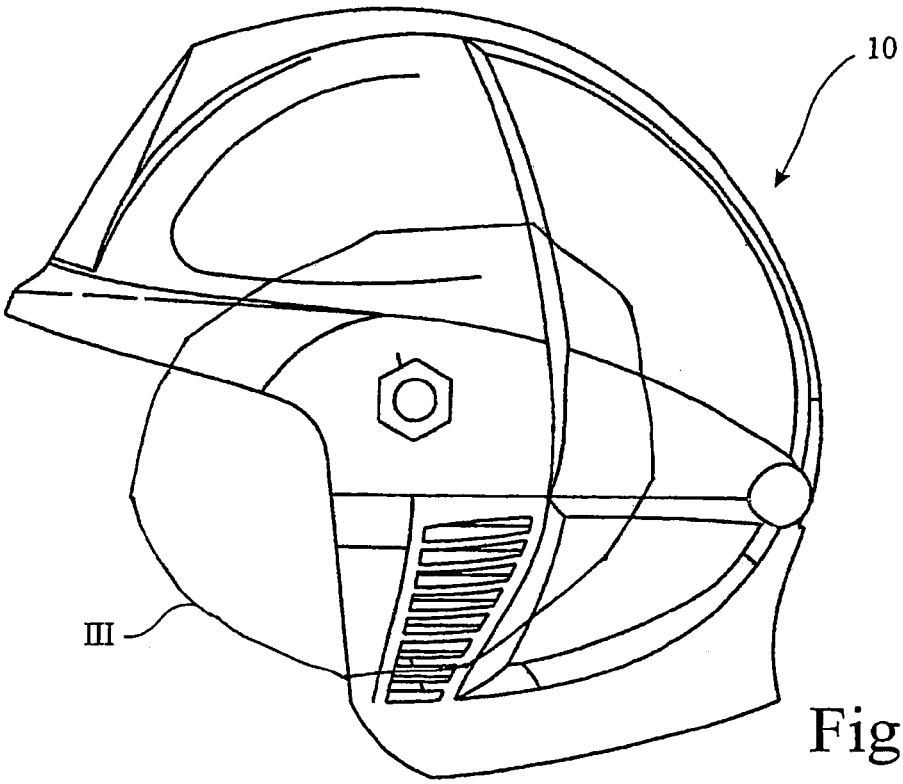
Figure 2A:
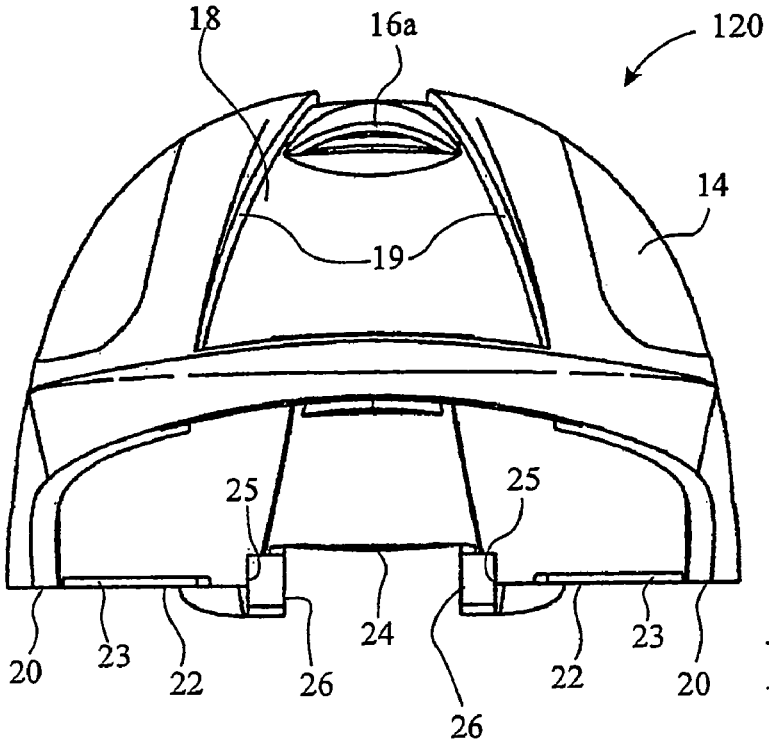
FIGS. 2*a*–2*d* show, respectively, a front view, rear view, plan view and side view of a helmet base in accordance with the present invention and forming part of the helmet of FIG. 1.
Figure 2B:
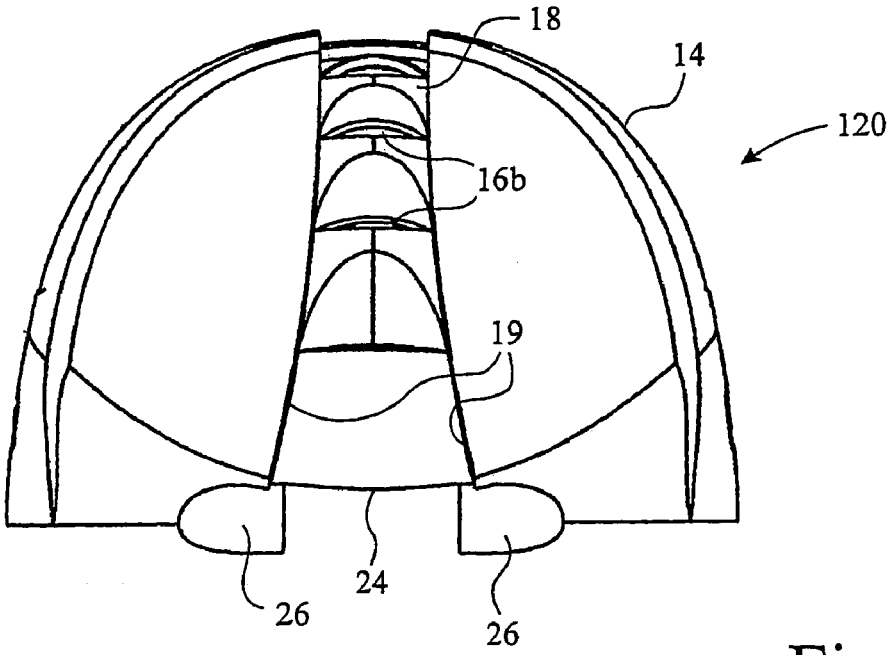
Figure 2C:
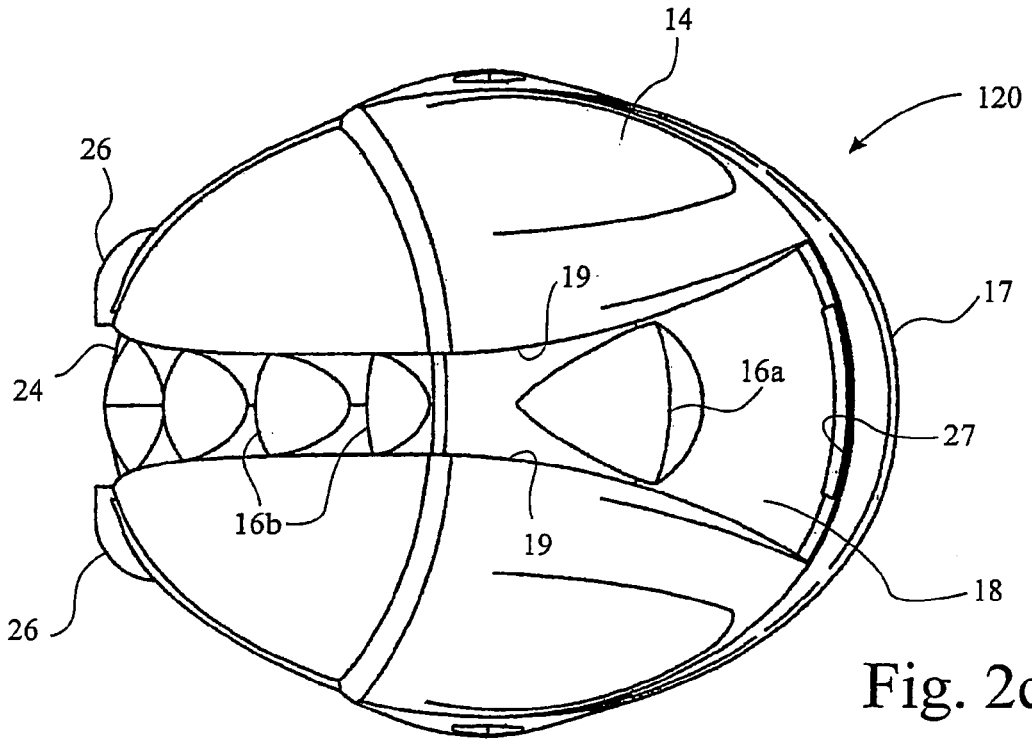
Figure 2D:
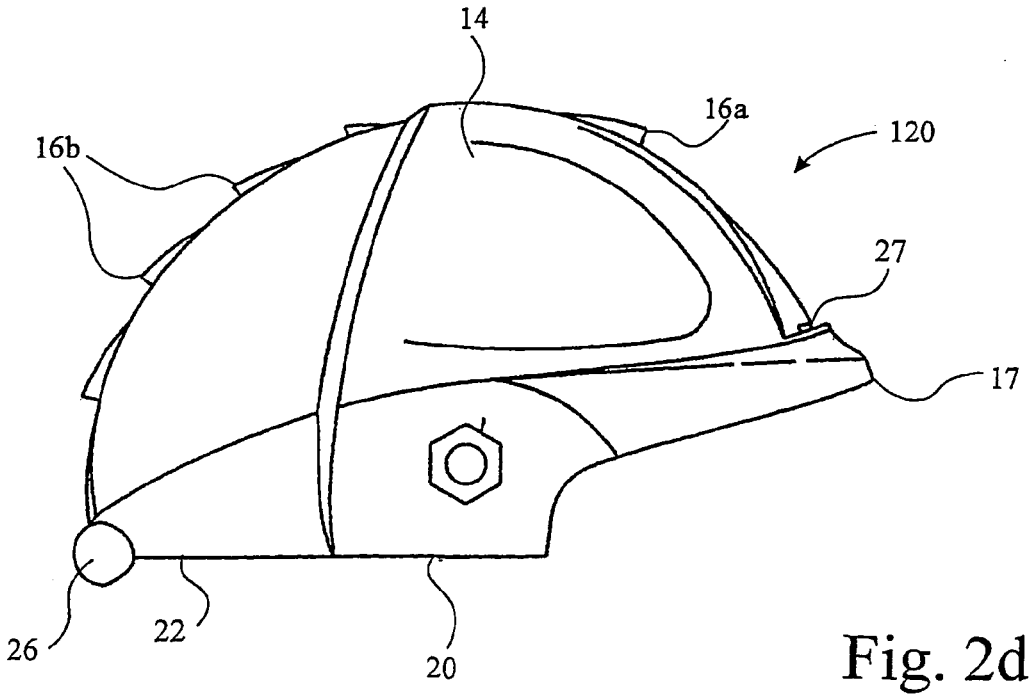

In the drawings, a helmet 10 is constructed from a helmet system in accordance with the present invention comprising three primary units. The first unit is a base helmet, generally designated 120, shown alone in FIGS. 2*a*–2*d*. The second unit is C-shaped extension, generally designated 140, shown alone in FIGS. 4*a*–4*d*, and the third unit is a crown comb, generally designated 160, shown alone in FIGS. 5*a*–5*d*. Each unit is injection molded from plastics material.

Referring first to the helmet base 120 in FIGS. 2*a*–2*d*, this comprises a domed shell 14 designed to fit on a user's head and provide protection against impacts towards the top of the wearer's skull. A series of ventilation windows 16*a*, 16*b* are provided over a central trench 18 over the top of the shell 14. One ventilation window 16*a* faces towards the front, and is relatively large, while four rearwardly facing ventilation windows 16*b* are provided towards the rear of the helmet shell 14. The front of the helmet base 120 has a peak 17 and side rims 20 merging into a rear rim 22. Rims 20 and 22 are coplanar. In the center of rim 22 is a hinge seat 24 defined between two C-shaped cups 26, one at either end of the seat 24. The cups 26 open towards the front, and have bottoms 25 facing one another.

Notches 23 are disposed on the inside of the rims 20 extending into the rims 22. A slot-opening 27 is formed in the bottom of trench 18 and penetrates the peak 17 of the shell 14.

Figure 4A:
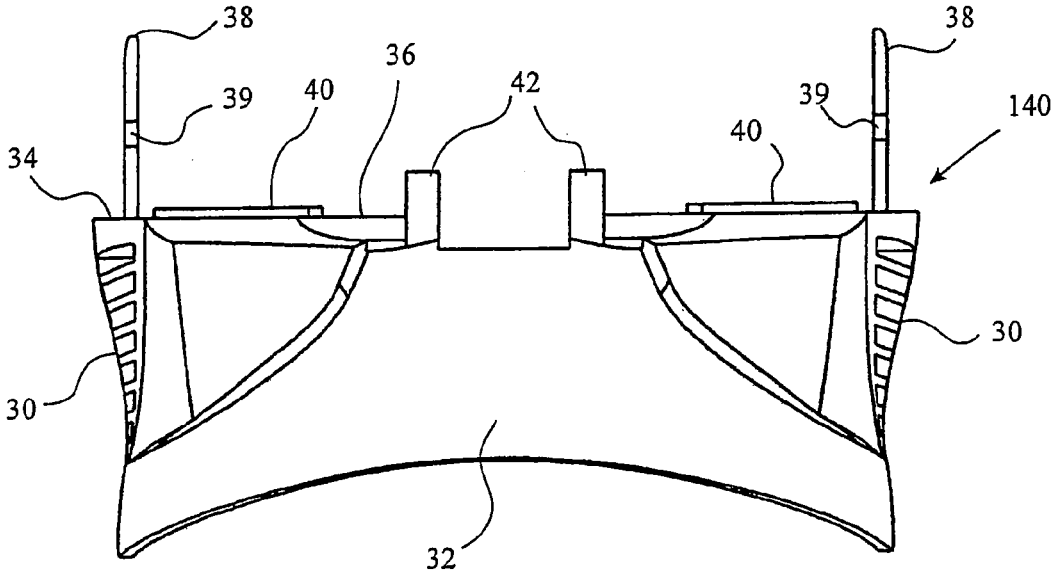
FIGS. 4*a*–4*c* show, respectively, a rear view, plan view and side view of an extension forming part of the helmet of FIG. 1.
Figure 4B:
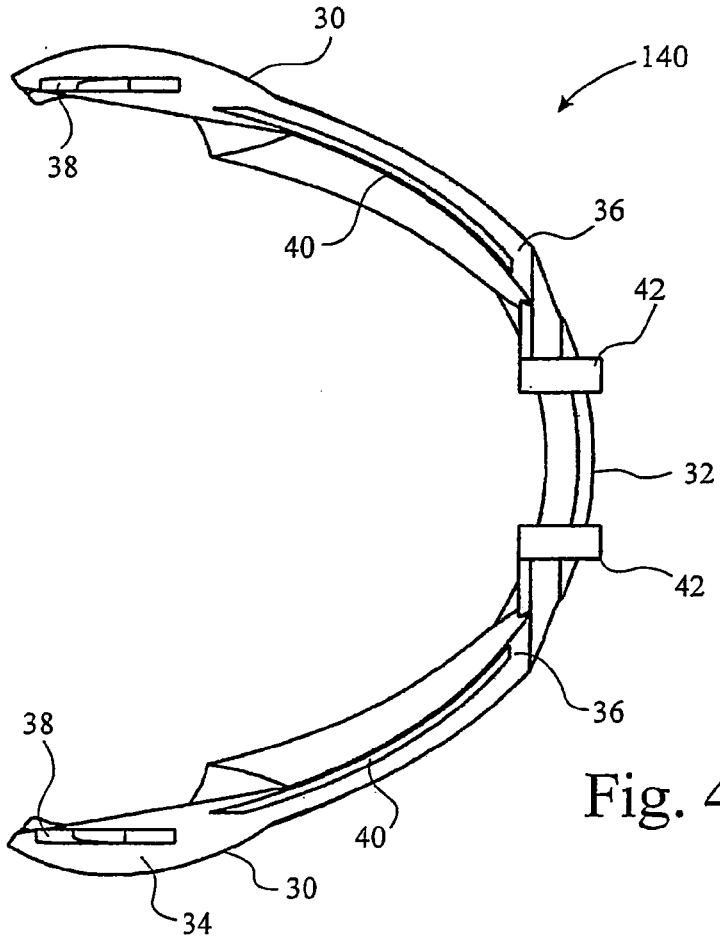
Figure 4C:
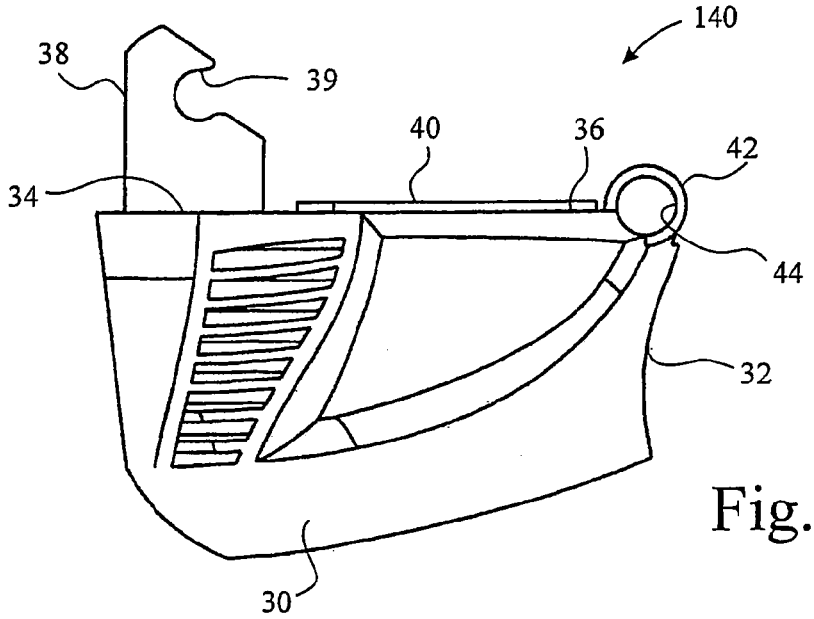
Figure 5A:
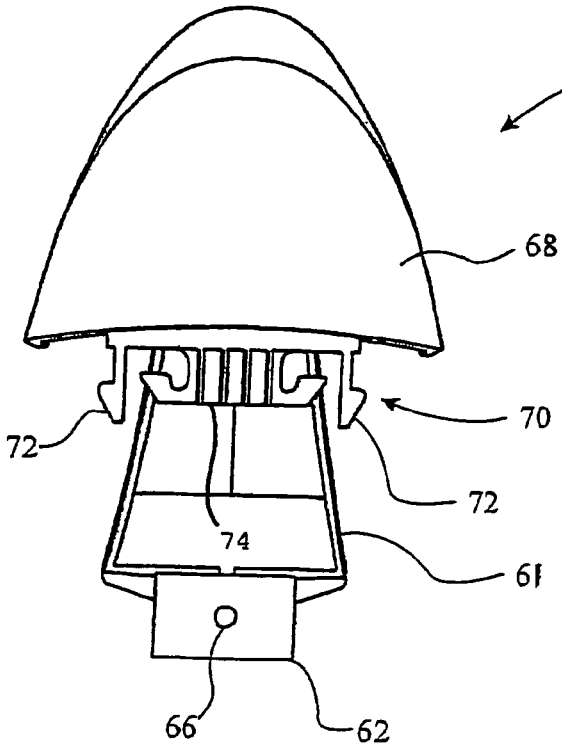
FIGS. 5*a*–5*d* show, respectively, a front view, rear view, plan view and side view of a crown comb forming part of the helmet of FIG. 1.
Figure 5B:
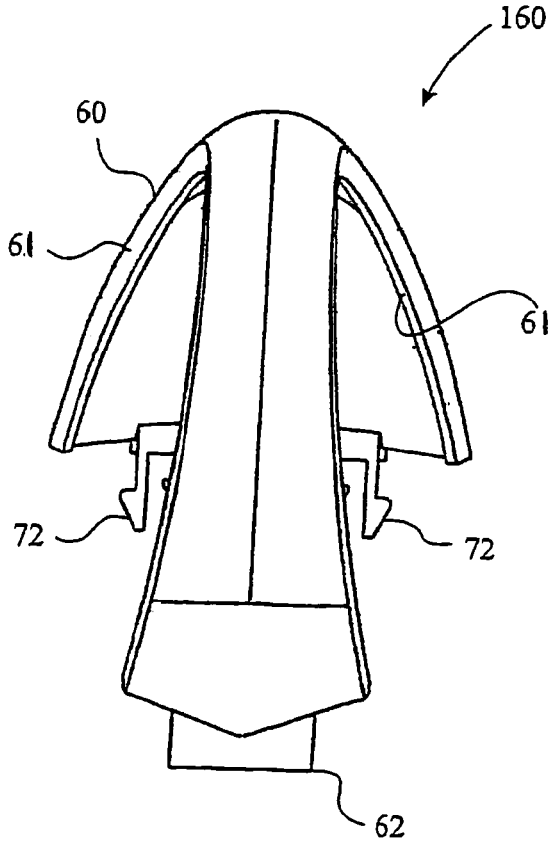
Figure 5C:
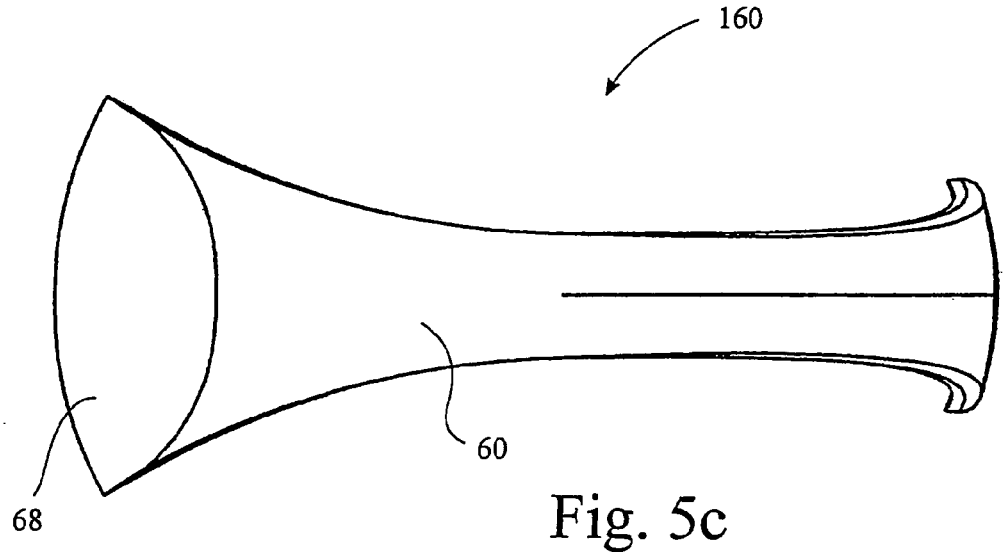
Figure 5D:
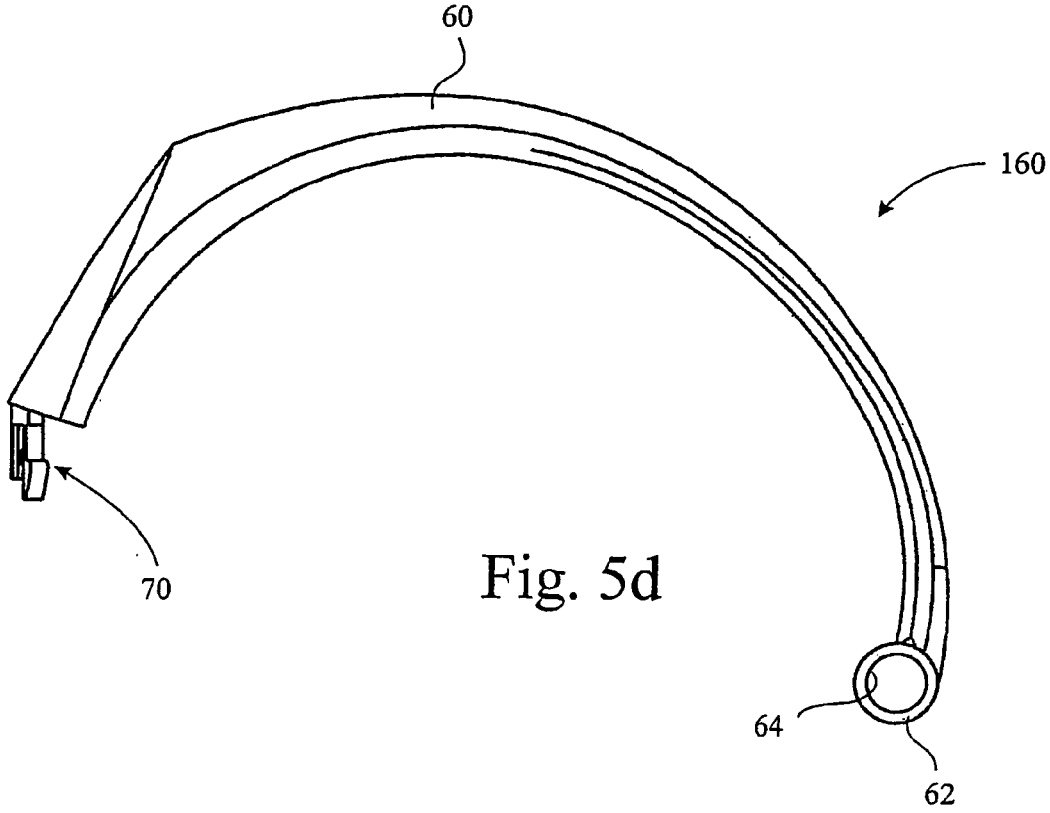

Turning to FIGS. 4*a*–4*c*, the extension 140 is C-shaped and comprises side arms 30 merging into body 32. The extension 140 likewise has a coplanar rim in the form of side rims 34 and merging into rear rim 36. Upstanding from the end of each arm 30, from the side rim 34, are two catch elements 38, comprising hooks 39 that are rearwardly opening. The rims 34 are provided with tongues 40 that extend into the rear rims 36. The tongues 40 correspond in size, shape and orientation with the notches 23 on the rims 20,22 in the helmet base 120 (see FIG. 2*a*).

Across the rear rim 36 are disposed two spaced, closed rings 42 integrally formed with the rest of the extension 140. The rings 42 have open bores 44.

Turning to FIGS. 5*a*–5*d*, the crown comb 160 comprises a curved channel section 60 having downwardly depending lips 61. At a rear end of the comb 160 is formed a sleeve 62 having a bore 64 of the same diameter as both the bore 44 of the rings 42 on the extension 140 (see FIG. 4*c*), and the cups 26 of the helmet base 120 (see FIGS. 2*a*, 2*b*, 2*d*). A hole 66 is formed in the side of the sleeve 62. This is to permit a ball (not shown) spring-loaded in a pin (not shown, but visible at 126 in FIG. 1*a*) to snap into the hole 66 and locate the pin in the sleeve 62 when the pin is inserted therein. The pin is of such a length that it extends beyond the ends of the sleeve 62. It is, in fact, the same length as the distance between the facing bottoms 25 of the cups 26 of the helmet base 120 (see FIG. 2*a*).

On the end of front 68 of the crown comb 160 is formed a latch 70. The latch 70 comprises two transversely and outwardly facing barbs 72 and a central support 74 adapted to support the barbs 72 and prevent excessive deflection thereof, as explained further below.

The helmet base illustrated in FIG. 2 has application in its own right, without further adaptation as explained below. The helmet is light, it provides a minimum level of head protection, and it has ventilation slots to permit a cooling airflow to the head of the user. Nevertheless, its primary application is as part of the overall system explained below. In this respect firefighters taking part in a rope rescue might employ the helmet in this configuration.

The helmet is not shown with the normal accoutrements of a helmet, such as the internal lining or the straps to retain the helmet in position, or an integral visor. These accoutrements are within the ambit of the person skilled in the art and form no part of the present invention.

The paramedic services generally require a greater level of protection, particularly from falling objects. On the other hand, they do not, on the whole, require side impact protection. Instead, they have a need to be able to communicate effectively with victims of an accident or fire to which they have been called. Moreover, paramedic personnel are not, on the whole, exerting themselves excessively, and therefore do not require helmet ventilation. Accordingly, in a first adaptation of the base helmet, the crown comb 160 can be connected to the base helmet 120. This is achieved by inserting the pin 126 into the sleeve 62 and then, from underneath the helmet base, clipping the ends of the pin extending from the sleeve 62 into the cups 26. The crown comb 160 is then pivoted over the top of the helmet base shell 14 until the latch 70 snaps into the slot-opening 27 in the bottom of trench 18 of the shell 14.

In this position, the lips 61 of the crown comb 160 abut sides 19 of the trench 18. In so doing, the ventilation windows 16 are sealed. Furthermore, the crown comb itself provides further impact resistance at this most vulnerable part of the helmet. Finally, the crown comb 160 also protects the helmet from everyday scuffs and scratches, so that replacement thereof from time to time has the effect of renovating the helmet.

The front surface 68 of the crown comb 160 is also an ideal location for indicia or decals to be applied, so that helmets can be personalized, and simply by connecting the appropriate crown comb 160.

Equally, however, firefighters might use the helmet in this configuration when full protection from side impacts and from flame and heat is not required.

Finally, firefighters in many situations require maximum protection, not only from objects falling vertically and impacting the crown of the helmet, but also frequently from the side. When building structures and the like collapse, they frequently throw objects with a horizontal trajectory. Firefighters also require heat and flame protection to the back and sides of the skull and neck region above the collar of their overcoat protection. Accordingly, the present invention provides the extension 140.

To connect this to the helmet base 120, the crown comb 160 is first connected to the extension 140. This is achieved by sliding the pin 126 through the bores 44 of the rings 42 while the sleeve 62 of the crown comb 160 is disposed between them. Again, once the ball in the pin snaps into engagement with the hole 66 in the sleeve 62, the crown comb 160 is securely connected to the extension 140.

Figure 3:
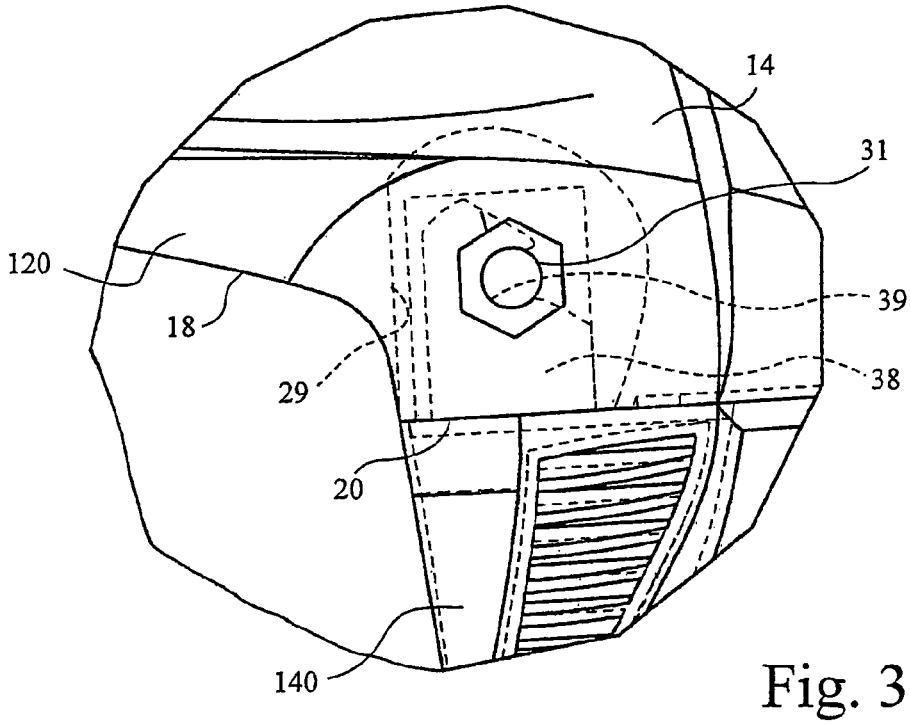
FIG. 3 is a detail of the area designated III in FIG. 1*d;*

The next stage is for the catch elements 38 to be inserted in a slot or pocket 29 (see FIG. 3) formed in the side of the shell 14 and opening downwardly in the front of the rim 20. Across the slot 29 there spans a catch lug 31 in the form of an axle for a bracket (not shown). The bracket would be provided for various accessories, useful to the rescue services, to be connected to the helmet. Such accessories include lamps and cameras, although that is not an exhaustive list.

In order to pass the hook 39 of the catch element 38 over the axle 31, the slot 29 is wider than the width of the catch element 38. Thus, the catch element is first inserted in an engagement direction that is essentially perpendicular to the plane of the rims 20,34. Then, the extension 140 is moved transversely to that engagement direction (that is to say, rearwardly with respect to the helmet base 120). At the same time, the ends of the pin 126 extending from the rings 42 are snapped into the mouths of the cups 26. Also at this time, the tongues 40 snap into engagement with the corresponding grooves in the side and rear rims 20, 22 of the helmet base shell 14. Thus three connections are effected substantially simultaneously: the hook 39 engages the axle 31; the tongues 40 engage the grooves in the helmet rims 20,22; and the pin 126 snaps into the cups 26.

To complete the connection and prevent corresponding disconnection of the extension from the helmet base 120, the crown comb 160 is pivoted over the top of the helmet, in the same way as described above, until the latch 72 engages the slot 27. This prevents the pin 127 from moving forward to disengage from cups 26. Indeed, in FIG. 1*a*, the pin 126 is illustrated in engagement with the cups 26, rings 42 and sleeves 62.

Also visible in FIG. 1*a* are the tips of the barbs 72. It is a feature of the present invention that these can be released from the slot opening 28 from inside the front of the helmet using a gloved hand by pressing them together. Because a wearer's touch sensitivity is limited through gloves, the support 74 prevents the wearer from deflecting the barbs, when they are pinched together, by an amount that will cause yielding of the plastics material.

Figure 6:
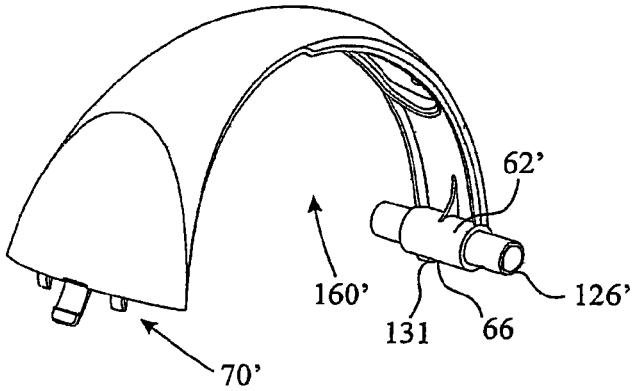
FIG. 6 is an exploded perspective view of a preferred form of helmet in accordance with the invention.
Figure 6:
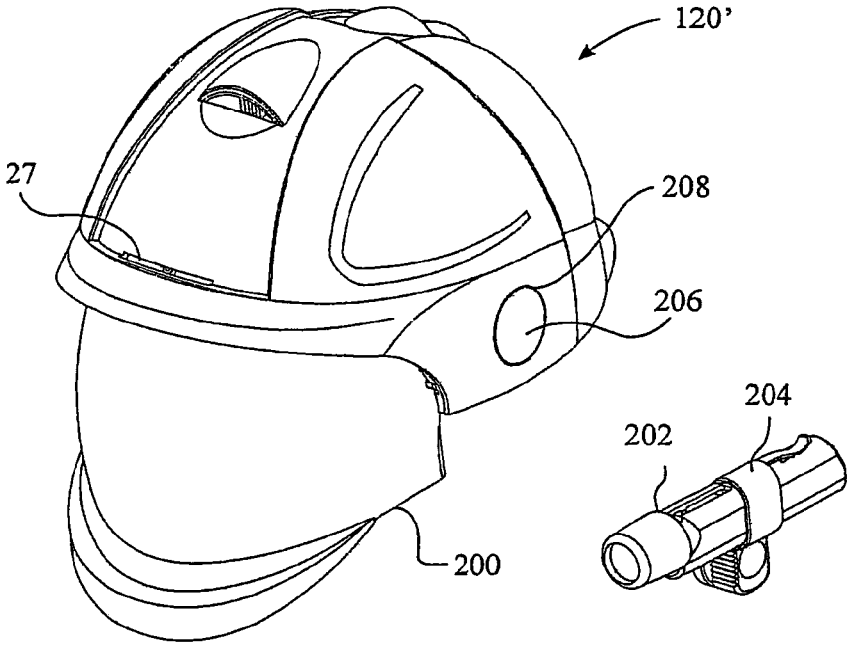
Figure 6:
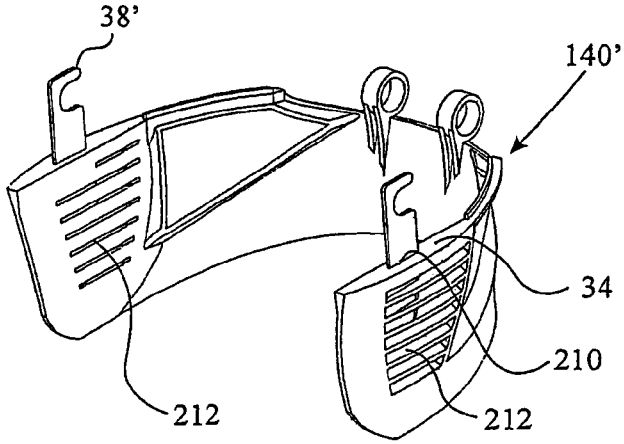

Turning to FIG. 6, this shows a preferred form of helmet which has the following modifications with respect to that described above.

In the first place, a modified latch 70' is provided for the comb 160'. Here, the latch is a simple barbed tab 72' adapted to hook under the lip of slot-opening 27 in the base helmet 120'. Secondly, pin 126' is here a hollow tube provided with an integral tongue hinged in its side having a lateral projection 131 that snaps into engagement with aperture 66' when the pin is slid into the sleeve 62' of the comb 160'.

In FIG. 6, helmet 120' is shown with an integral visor 200 which is pivoted in the helmet by any convenient means within the ambit of a person skilled in the art. Therefore, the visor is not described further, save to say that, in this case, it is provided with three arcuate rails (not visible in the drawings), two on either side and one in the middle at its top. The helmet base is likewise provided with three correspondingly positioned tracks (also not shown) through which the rails can slide to move the visor between the operative position shown in FIG. 6 and a stowed position inside the helmet base 120'. Space is provided for this purpose between the shell of the helmet base and the seating for the users head retained inside the helmet.

A lamp 202 is shown received in a lamp bracket 204 connectable to the side of the helmet by being screwed into a thread formed in axle 31. Axle 31 is not visible in FIG. 6 because a cover-blank 206 hides connection port 208, and the axle 31, for the bracket 204 when it is not employed.

Finally, extension 140' differs little from that described above except that catch elements 38' are here separate components from the extension and constructed from different material to provide extra strength and rigidity. They are pressed/snapped into slots 210 formed in the rim faces 34 and are provided with barbs to prevent their subsequent removal.

Although the extension provides protection from a number of attacks, including heat and flame, nevertheless, ventilation slots 212 are provided through which cooling air may be drawn.

While the forms of apparatus herein described constitute preferred embodiments of the invention, it is to be understood that the invention is not limited to these precise forms of apparatus, and that changes may be made therein without departing from the scope of the invention.

What is claimed is:

1. A modular helmet system comprising:

i) a helmet base shaped to protect from impacts the crown of a wearer's head and having a crown and terminating basally in a rear rim and side rim;

ii) a substantially C-shaped extension detachably connected to said rims to protect from impacts, when fitted to the helmet base, the side and rear of a wearer's skull; and iii) a crown comb detachably connectable substantially centrally over the crown of the helmet base and arranged, when said extension is employed, to secure said extension in place on the helmet base.

2. The helmet system of claim 1 in which said helmet base is provided with ventilation windows.

3. The helmet system of claim 2 in which said windows are centrally located over the crown of the helmet base.

4. The helmet system of claim 3 in which said comb covers and seals said ventilation windows when connected to said helmet base.

5. The helmet system of claim 1 in which said comb is detachably connectable to the helmet base independently of the extension.

6. The helmet system of claim 1 in which said extension has at least two arms and a body, at substantially the end of each said arm there being provided an upstanding catch element, said side rims each having a slot to receive said catch elements when said base and extension are moved towards one another in an engagement direction.

7. The helmet system of claim 6 in which said slots include catch lugs, said catch lugs being positioned to engage said catch elements by movement of said catch elements transverse to said engagement direction after the catch elements are moved into said slots.

8. The helmet system of claim 6 in which said comb has a sleeve at its base shaped to receive a pin, and said helmet base has a pair of open-sided cups facing one another at a back of the helmet base, said open sides opening towards a front of the helmet base, and further including a pin whereby said comb is connected to said helmet base by inserting said pin in said sleeve, engaging the ends of said pin in said cups, and rotating the comb about said pin so as to lever the comb over the crown of the helmet base.

9. The helmet system of claim 8 in which said comb has a latch on its front end remote from said sleeve and adapted to engage a corresponding element on the front of the helmet base.

10. The helmet system of claim 9 in which said latch comprises a pair of resilient prongs terminating in transversely and outwardly facing barbs.

11. The helmet system of claim 10 in which said corresponding element comprises a slot opening in the front wall of the helmet base, shaped to receive and engage said prongs such that said barbs snap into engagement with ends of said slot opening.

12. The helmet system of claim 11 in which said prongs are positioned to release said comb from the helmet base from under and inside the front of the helmet base.

13. The helmet system of claim 8 in which said extension has a pair of coaxial rings on its body, said rings having an inner separation therebetween that is slightly greater than a length of said sleeve, and said cups being separated from one another by an amount slightly greater than an outer separation of said rings, whereby said extension is connectable to said helmet base by engaging said comb with said extension by sliding said pin through said rings and sleeve when said rings are aligned with and surround the sleeve;

engaging said catch elements in said slots by movement of the extension towards the helmet base in said engagement direction and until said extension abuts said rims and said catch elements are aligned with said catch lugs; and simultaneously engaging the ends of the pin in the mouths of said cups by movement of the extension in said direction transverse said engagement direction and by pivoting the comb around said pins to lever it over the crown of the helmet base, pull said pin into full engagement with the cups, and also pull the catch elements into engagement with the catch lugs, and whereby the pin is prevented from disengaging said cups, said sleeve and rings.

14. The helmet system of claim 13 in which said crown comb is positioned to engage said helmet base to prevent the extension from moving opposite said transverse direction to release said elements and lugs.

15. The helmet system of claim 6 in which said catch elements comprise hooks and said lugs comprise studs.

16. The helmet system of claim 15 in which the hooks include openings facing rearwardly with respect to the helmet base.

17. The helmet system of claim 15 in which said studs serve as axles of accessory attachment brackets provided on sides of the helmet base, and said slots include apertures shaped to receive the axles.

18. The helmet system of claim 1 in which said rims, and said extension are provided with corresponding and engaging tongues and notches.

19. The helmet system of claim 7 further comprising catch lugs positioned in said slots and in which said catch elements engage said catch lugs by movement transverse to said engagement direction after the catch elements are moved into said slots, and in which said extension is provided with corresponding and engaging tongues and notches, said tongues and notches being positioned in the region of said rims and meeting extension where said tongues and notches extend substantially parallel to said transverse direction.

20. A crown comb for a helmet system comprising a curved channel section having a hinge element at a rear end thereof, shaped to attach to a complementary hinge element of a helmet base, and a latch at a front end thereof shaped to engage a complementary latch element of a helmet base.

21. An extension for a helmet system having a generally C-shape and adapted to be attached to a helmet base to protect the side and rear of a wearer's skull, said extension having a bore configured to receive a pin therethrough to couple said extension to a rear rim of said helmet base.

22. The extension of claim 21 wherein said extension includes a ring having said bore therein.

23. The extension of claim 21 wherein said bore is configured to receive said pin therethrough to couple said extension to said rear rim such that said extension is pivotally mounted to said helmet base about an axis oriented generally tangent to said rear rim of said helmet.

24. A modular helmet system comprising:

a helmet base shaped to protect the crown of a head of a wearer from impacts and having a domed shell;

an elongate trench formed in and extending substantially longitudinally and centrally of said shell; and a plurality of ventilation windows formed in said trench to permit cooling airflow to the head of a wearer when said helmet is worn, the helmet system further comprising releasable connector components positioned proximate front and rear ends of said trench and shaped to engage complementary connector components of a trench-covering piece.

25. The helmet system of claim 24 wherein said trench-covering piece comprises a crown comb shaped to engage said trench and cover said ventilation windows; said crown comb having complementary connector components shaped to engage said connector components such that said crown comb is selectively attachable to and detachable from said helmet base; said comb being constructed of a material that provides said shell increased resistance to impacts from above said helmet base.

26. A modular helmet system comprising:

a helmet base shaped to protect the crown of a head of a wearer from impacts and having a domed shell defining an inner cavity confirmed and located to receive the crown of the head of a wearer therein;

an elongate trench formed in and extending substantially longitudinally and centrally of said shell; and a plurality of ventilation windows formed in said trench and communicating with said inner cavity, wherein each window provides a path of direct fluid communication from outside said helmet base to said inner cavity to permit cooling airflow to the head of a wearer when said helmet is worn.

27. The helmet system of claim 26 wherein said helmet base includes opposing side rims and a rear rim and further comprising an extension shaped to be selectively attachable to and releasable from said side and rear rims and extend downwardly from said side and rear rims to provide heat, flame and impact protection for the back and sides of the skull and neck region of a wearer.

28. The helmet system of claim 27 wherein said shell includes a pair of slots and said extension includes a pair of catch elements shaped and positioned to releasably engage said slots.

29. The helmet system of claim 28 wherein said rear rim includes a releasable attachment bracket and said extension includes a body having a complementary releasable attachment bracket such that said extension is releasably attached to said helmet base by engagement of said slots and catch elements, and said attachment bracket and said complementary releasable attachment bracket.

30. The helmet system of claim 29 wherein said releasable attachment bracket includes a pin attached to said shell and said complementary releasable attachment bracket includes a pair of rings shaped to receive said pin.

31. The helmet system of claim 30 wherein said releasable attachment bracket further includes a hinge seat shaped to receive ends of said pin.

32. The helmet system of claim 31 wherein said hinge seat includes a pair of opposing cups shaped to receive ends of said pin.

33. The helmet system of claim 31 further comprising a crown comb shaped to engage said trench and cover said ventilation windows; said crown comb having complementary connector components shaped to engage said connector components such that said crown comb is selectively attachable to and detachable from said helmet base; said comb being constructed of a material that provides said shell increased resistance to impacts from above said helmet base; said complementary connector component including a sleeve shaped to receive and secure said pin therein; whereby said pin interconnects said crown comb, said extension and said shell.

34. The system of claim 26 wherein said helmet base lacks any ventilation windows that communicate with said inner cavity that are not located in said trench.

35. The system of claim 26 wherein said helmet base is configured to removably receive a crown comb thereon such that when said crown comb is received on said helmet base said crown comb seals said plurality of ventilation windows.

36. The system of claim 35 further comprising said crown comb.

37. A helmet system comprising:

a helmet extension having a generally "C" shape;

said extension having side arms and a body, said side arms merging into said body;

said extension having a complementary attachment bracket shaped to pivotally engage an attachment bracket of a helmet base such that, when attached to a helmet base, said extension extends downwardly therefrom, thereby providing heat, flame and impact protection to the back and sides of the skull and the neck region of a wearer of an associated helmet base.

38. The system of claim 37 wherein said bracket has a bore configured to receive a pin therethrough to couple said extension to a rear surface of said helmet base.

39. The system of claim 38 wherein said bracket includes a ring having said bore therein.

40. The system of claim 38 wherein said bore is configured to receive said pin therethrough to couple said extension to said rear surface of said helmet base such that said extension is pivotally mounted to said helmet base about an axis oriented generally tangent to said rear surface.

41. A modular helmet system comprising:

a helmet base shaped to protect the crown of a head of a wearer from impacts and having a domed shell, wherein said helmet base includes a pair of slots, opposing side rims and a rear rim;

an elongate trench formed in and extending substantially longitudinally and centrally of said shell; and a plurality of ventilation windows formed in said trench to permit cooling airflow to the head of a wearer when said helmet is worn, wherein the system further comprises an extension shaped to be selectively attachable to and releasable from said side and rear rims and extend downwardly from said side and rear rims to provide heat, flame and impact protection for the back and sides of the skull and neck region of a wearer, wherein the extension includes a pair of catch elements shaped and positioned to releasably engage said slots, wherein said rear rim includes a releasable attachment bracket and said extension includes a body having a complementary releasable attachment bracket such that said extension is releasably attached to said helmet base by engagement of said slots and catch elements, and said attachment bracket and said complementary releasable attachment bracket, and wherein said releasable attachment bracket includes a pin attached to said shell and said complementary releasable attachment bracket includes a pair of rings shaped to receive said pin.

* * * * *